US006635355B2

(12) United States Patent
Bianco et al.

(10) Patent No.: US 6,635,355 B2
(45) Date of Patent: Oct. 21, 2003

(54) FERROUS METAL ARTICLE HAVING OXIDE COATING FORMED FROM THE BASE METAL SUITABLE FOR BRAKE APPARATUS ET AL

(75) Inventors: Robert Bianco, Strongsville, OH (US); Thomas D. Nixon, Akron, OH (US); John P. Swank, Troy, OH (US)

(73) Assignee: The B.F.Goodrich Company, Richfield, OH (US)

( * ) Notice: Subject to any disclaimer, the term of this patent is extended or adjusted under 35 U.S.C. 154(b) by 0 days.

(21) Appl. No.: 10/308,345

(22) Filed: Dec. 2, 2002

(65) Prior Publication Data

US 2003/0138648 A1 Jul. 24, 2003

Related U.S. Application Data

(63) Continuation of application No. 09/267,556, filed on Mar. 12, 1999, now abandoned.

(51) Int. Cl.[7] ..... B32B 15/04; F16D 65/00

(52) U.S. Cl. ..... 428/469; 428/471.1; 428/472.2; 188/251 A; 188/251 M

(58) Field of Search ..... 428/469, 472.1, 428/472.2; 148/286, 287, 280; 188/251 M, 251 A, 255, 218 XL

(56) References Cited

U.S. PATENT DOCUMENTS

| | | | | |
|---|---|---|---|---|
| 4,017,336 | A | * | 4/1977 | Foroulis |
| 4,483,720 | A | | 11/1984 | Bartlett et al. |
| 5,370,838 | A | * | 12/1994 | Sato et al. |
| 5,789,086 | A | * | 8/1998 | Ohmi |
| 5,800,634 | A | | 9/1998 | McWilliams et al. |

FOREIGN PATENT DOCUMENTS

| | | |
|---|---|---|
| BE | 341487 | 3/1927 |
| GB | 2 148 187 A | 5/1985 |

OTHER PUBLICATIONS

SUPERALLOYS Source Book, Matthew J. Donachie, Jr.—American Society for Metals, 1984, (pp. 351–355) No month.

* cited by examiner

*Primary Examiner*—Deborah Jones
*Assistant Examiner*—Jennifer McNeil
(74) *Attorney, Agent, or Firm*—Brinks Hofer Gilson and Lione

(57) ABSTRACT

Disclosed is a ferrous metal article having a protective, adherent, wear resistant coating of metallic oxides and a method of forming a protective, adherent, wear resistant coating of metallic oxides on an iron-chrome article. The coating desirably has a thickness of from about 12.7 to about 102 microns (½ mil to about 4 mils) and is formed by exposure of the article to an oxidizing atmosphere, preferably air, preferably during heat treatment of the article.

20 Claims, 5 Drawing Sheets

Figure 3A: Secondary Electron Image
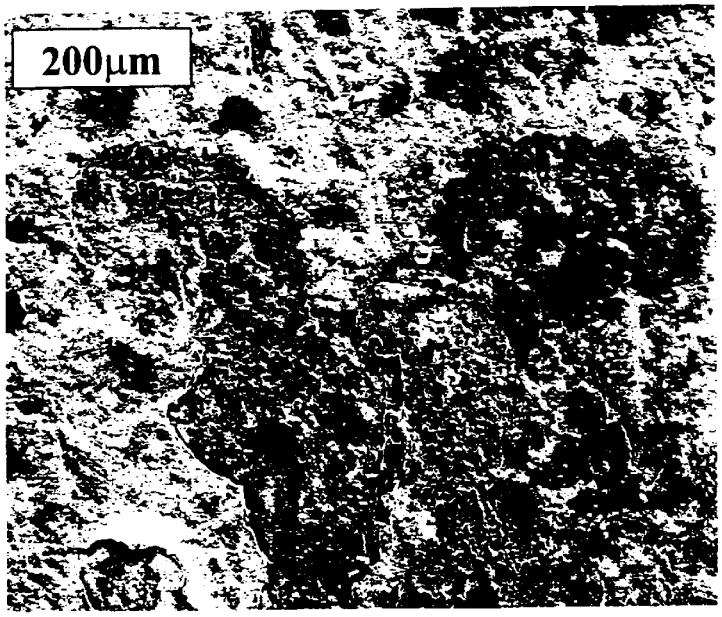
EDS Elemental Images
Figure 3B: Oxygen
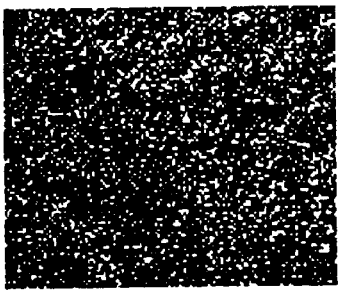
Figure 3C: Titanium
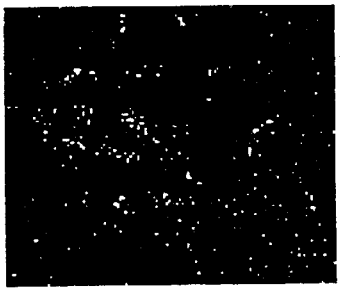
Figure 3D: Chromium
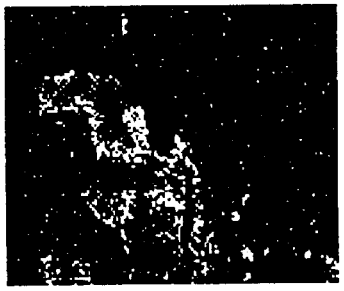
Figure 3E: Iron
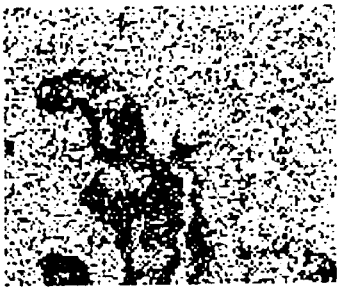
Figure 3F: Nickel
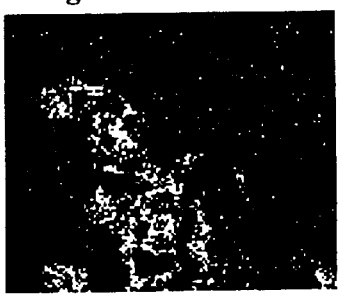
Figure 3G: Background
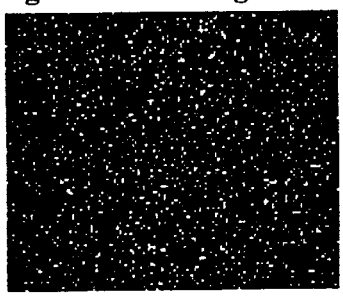

Figure 4A: Secondary Electron Image
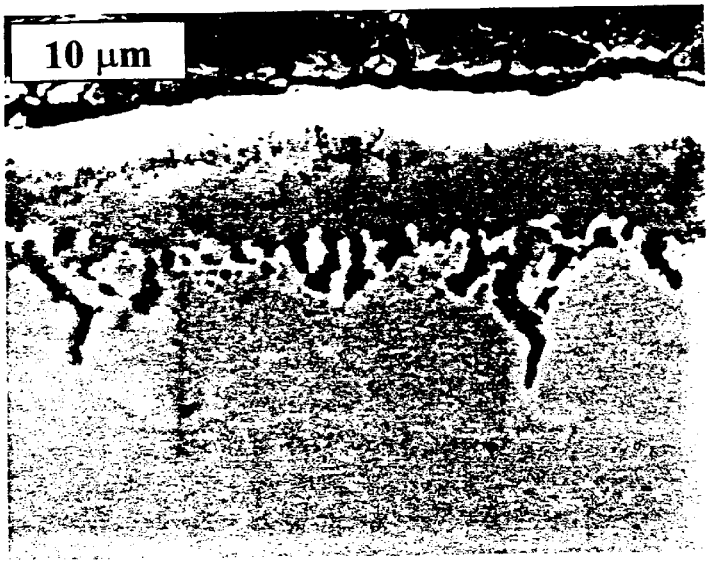
EDS Elemental Images
Figure 4B: Oxygen
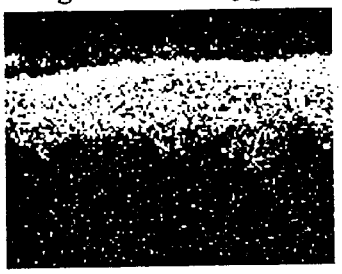
Figure 4C: Titanium
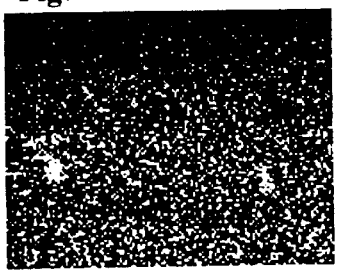
Figure 4D: Chromium
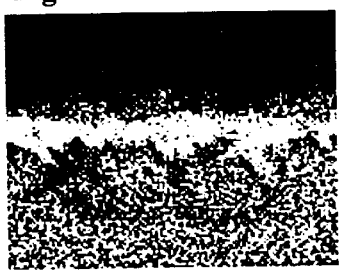
Figure 4E: Iron
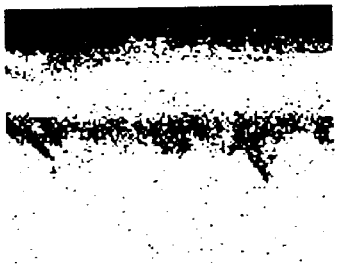
Figure 4F: Nickel
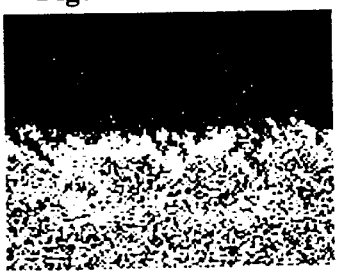
Figure 4G: Background
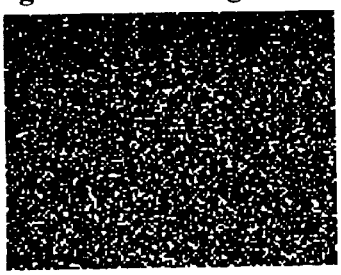

FERROUS METAL ARTICLE HAVING OXIDE COATING FORMED FROM THE BASE METAL SUITABLE FOR BRAKE APPARATUS ET AL

This application is a continuation of application Ser. No. 09/267,556, filed Mar. 12, 1999, now abandoned, which is hereby incorporated by reference herein.

This invention pertains to a ferrous metal articles having a protective, adherent, wear resistant coating of metallic oxides and methods of forming a protective, adherent, wear resistant coating of metallic oxides on such articles. The coating desirably has a thickness of from about 6 to about 102 microns (¼ mil to about 4 mils) and is formed by exposure of the article to an oxidizing atmosphere, preferably air, preferably during heat treatment of the article. Such articles are useful, inter alia, as torque drive inserts for a friction disk for a multi-disk brake or clutch assembly. Such a friction brake disk assembly has a plurality of axially aligned annular shaped rotor disks splined for axial movement interleaved with annular stator disks which are splined for axial movement along a mating key member or members that are fixedly secured to a torque tube. Each of the stator disks and the rotor disks has a plurality of circumferentially spaced slots along the periphery, with metallic reinforcing drive inserts therein to transfer the load to the disks. The drive inserts are formed of an alloy such as A286 alloy steel having an adherent coating of metal oxides formed by controlled oxidation of the underlying base metal. The inventors have discovered that the material of the drive inserts can have a significant influence on the dynamic stability of a multi-disk brake.

BACKGROUND OF THE INVENTION

Foley et al. disclose the results of their evaluation of the sliding frictional characteristics of cobalt on cobalt, nickel on nickel and iron on iron under different atmospheric conditions over a range of temperatures using a hemispherically shaped pin in continuous sliding contact at 3.63 m/min on a rotating disk (R. T. Foley, M. B. Peterson, and C. Zapf, *Frictional Characteristics of Cobalt, Nickel, and Iron as Influenced by Their Surface Oxide Films*, ASLE Transactions 6, 1963, pp. 29–39). Although considerable data is presented that indicates that behavior varies widely among these different metals as the temperature and the atmosphere change, no guidance is given as to the potential behavior of complex systems such as alloyed steels.

Rabinowicz suggests that an oxide film of about 0.01 micron thickness on the base metal is needed to provide effective dry lubrication (E. Rabinowicz, *Lubrication of Metal Surfaces by Oxide Films*, ASLE Transactions 10, 1967, pp. 400–407). Considerable data is presented that indicates that behavior varies widely among different metals including nickel riding on type 303 stainless steel, type 303 stainless steel riding on nickel, nickel riding on nickel, and type 303 stainless steel riding on itself, as the temperature and the atmosphere change.

A method of forming protective coatings of co-deposited aluminum oxide and titanium oxide on wear surfaces of substrates such as hardened or treated steel or cemented carbides is disclosed in U.S. Pat. No. 4,052,530 to Fonzi. According to this patent, the coating is formed by simultaneously reacting an aluminum halide gas and a titanium halide gas with water on a surface maintained at a temperature of about 900° C. to about 1250° C. The coating comprises alpha alumina ($Al_2O_3$) with about 2% to about 10% hexagonal alpha titanium oxide ($Ti_2O_3$) dispersed in the alumina matrix. The process of Fonzi requires use of chemical vapor deposition with attendant special process equipment and costs, and may deleteriously affect the morphology of the substrate ferrous alloy due to use of relatively long times at temperatures.

This invention relates to ferrous alloy articles having a wear resistant coating of metallic oxides that are formed by controlled oxidation of the base alloy, and to a method of forming an adherent, metallic oxides coating on an article comprising a substrate of ferrous alloy of the following general composition expressed in weight present: C 0–0.08, Cr 13.5–16, Ni 24–27, Fe balance. Other alloying elements may be present. The coating has a thickness of from about 6 microns (¼ mil) to about 102 microns (4 mils), or from about 13 microns (½ mil) to about 76 microns (3 mils), or from about 25.5 microns (1 mil) to about 51 microns (2 mils) and is formed by exposure of the article to an oxidizing atmosphere, preferably air, preferably during heat treatment of the article.

The present invention also relates to friction braking systems and more particularly to aircraft friction disks with reinforced peripheral slots for use in multiple disk brakes. In brake assemblies which employ a plurality of brake disks alternately splined to the wheel and axle of an aircraft, it is important to provide specially constructed drive means to reinforce peripheral slots in the disks to relieve the severe stressing that otherwise would rapidly deteriorate the periphery of the disks. When disk brakes were constructed of steel, the disks were able to withstand the shearing and compressive forces exerted thereon between the slots and the torque transmitting members because of their physical properties. With the replacement of the steel disks with carbon and/or ceramic composite disks it is important to provide reinforcing drive inserts at the peripheral slots since the composite materials have less durability under this type of loading than steel. The drive inserts transmit the forces to the composite disks, over a larger area reducing the contact stresses which increases the load capability of the composite composite disks.

The present invention preferably utilizes a torque drive insert such as that described in U.S. Pat. No. 4,469,204. Such drive insert in the peripheral slots engages the composite disk and drives on the rotating member or transfers the stress to the stationary member without deleterious effects on the carbon composite materials. The drive insert has a pair of opposed faces which frictional contact the opposite walls of the slots to distribute the load. The drive insert design uses a channel to retain the drive inserts in position within the slot. Such structure eliminates peeling or fraying of the carbon composite heat sink material while also taking up some of the stresses due to misalignment in the wheel and brake. The structure of the drive insert and clip provides for a large bearing area in the carbon composite and minimizes the weight required to obtain the strength to handle the side loads in case of some misalignment. The construction permits the drive insert to float freely in the slot of the carbon disk thereby eliminating the tension loading of the attaching rivets.

SUMMARY OF THE INVENTION

The present invention contemplates an iron-chrome alloy article having a protective coating of adherent, wear resistant, metallic oxides and a method of forming a coating of protective, adherent, metallic oxides on an article comprising a substrate of iron-chrome alloy. The coating has a thickness of from about 6 microns (¼ mil) to about 102 microns (4 mils), and more preferably is at least about 12 microns (½ mil) in thickness and is formed by exposure of the article to an oxidizing atmosphere, preferably air, preferably during heat treatment of the article. The invention also contemplates most specifically, a multi-disk brake having disks with torque drive inserts formed of oxide-coated A286 alloy steel.

The present invention also contemplates a friction brake disk type assembly with the disks having flat annular surfaces and a plurality of circumferentially spaced slots along the outer periphery of the rotating disks and slots along the inner periphery of a stationery disk. A torque drive insert is positioned within each slot for contact with either the spline of a torque device in the case of the rotating disk or with key members that are fixedly secured to a stationary torque tube. The drive inserts are U-shaped with each leg having a pair of side portions that extend away from the slots along the flat annular surface of the disk. Clips are fixedly secured to the disks and retain the drive inserts within their slots permitting a slight degree of movement because of a clearance space between the clips and the drive inserts. Certain surfaces of the drive insert are subjected to sliding frictional contact with their associated confronting surfaces of the associated torque drive member, e.g. of an aircraft wheel as the loaded wheel rotates. A multi-disk brake provided with drive inserts formed of oxide-coated A286 alloy steel provides increased stability against vibration during a braking event compared to an otherwise identical brake having a brake stack in which all of the drive insert are formed of AMS 5385F cobalt-base alloy which is commercially available as Stellite™ 21 alloy from The Haynes Stellite Co., Kokomo, Ind. or Stoody Deloro Stellite, Inc., St. Louis, Mo.

BRIEF DESCRIPTION OF THE DRAWINGS

FIG. 3A is a secondary electron photomicrograph of the surface of an oxide coated article according to the invention.

FIG. 3B is an EDS (Energy Dispersive Spectroscopy) elemental image photomicrograph corresponding to FIG. 3A at reduced scale and depicting the oxygen content of the surface of the oxide coated article.

FIG. 3C is an EDS elemental image photomicrograph corresponding to FIG. 3A at reduced scale and depicting the titanium content of the surface of the oxide coated article.

FIG. 3D is an EDS elemental image photomicrograph corresponding to FIG. 3A at reduced scale depicting the chromium content of the surface of the oxide coated article.

FIG. 3E is an EDS elemental image photomicrograph corresponding to FIG. 3A at reduced scale depicting the iron content of the surface of the oxide coated article.

FIG. 3F is an EDS elemental image photomicrograph corresponding to FIG. 3A at reduced scale depicting the nickel content of the surface of the oxide coated article.

FIG. 3G is an EDS elemental image photomicrograph corresponding to FIG. 3A at reduced scale depicting the background emission from the surface of the oxide coated article.

FIG. 4A is a secondary electron image photomicrograph of a cross-section through the thickness of an oxide coated article according to the invention.

FIG. 4B is an EDS elemental image photomicrograph corresponding to FIG. 4A at reduced scale and depicting the oxygen content of the cross-sectioned surface of the oxide coated article.

FIG. 4C is an EDS elemental image photomicrograph corresponding to FIG. 4A at reduced scale and depicting the titanium content of the cross-section of the oxide coated article.

FIG. 4D is an EDS elemental image photomicrograph corresponding to FIG. 4A at reduced scale depicting the chromium content of the cross-section of the oxide coated article.

FIG. 4E is an EDS elemental image photomicrograph corresponding to FIG. 4A at reduced scale depicting the iron content of the cross-section of the oxide coated article.

FIG. 4F is an EDS elemental image photomicrograph corresponding to FIG. 4A at reduced scale depicting the nickel content of the cross-section of the oxide coated article.

FIG. 4G is an EDS elemental image photomicrograph corresponding to FIG. 4A at reduced scale depicting the background emission from the cross-section of the oxide coated article.

DESCRIPTION OF THE PREFERRED EMBODIMENT

Figure 1:
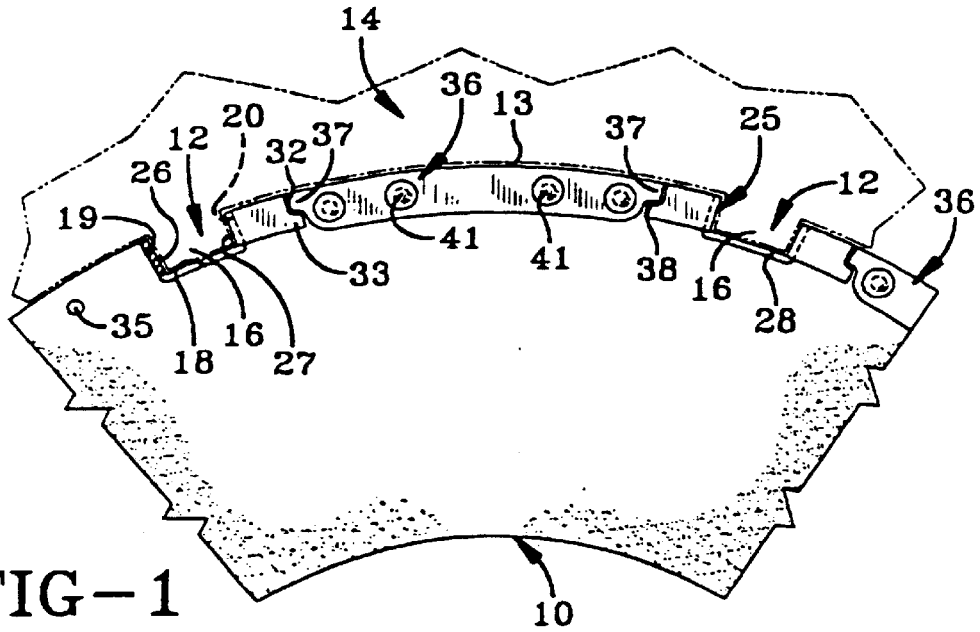
FIG. 1 is a fragmentary side elevational view of a brake disk assembly with a key slot and torque drive insert secured to the respective peripheral slots by clips.
Figure 2:
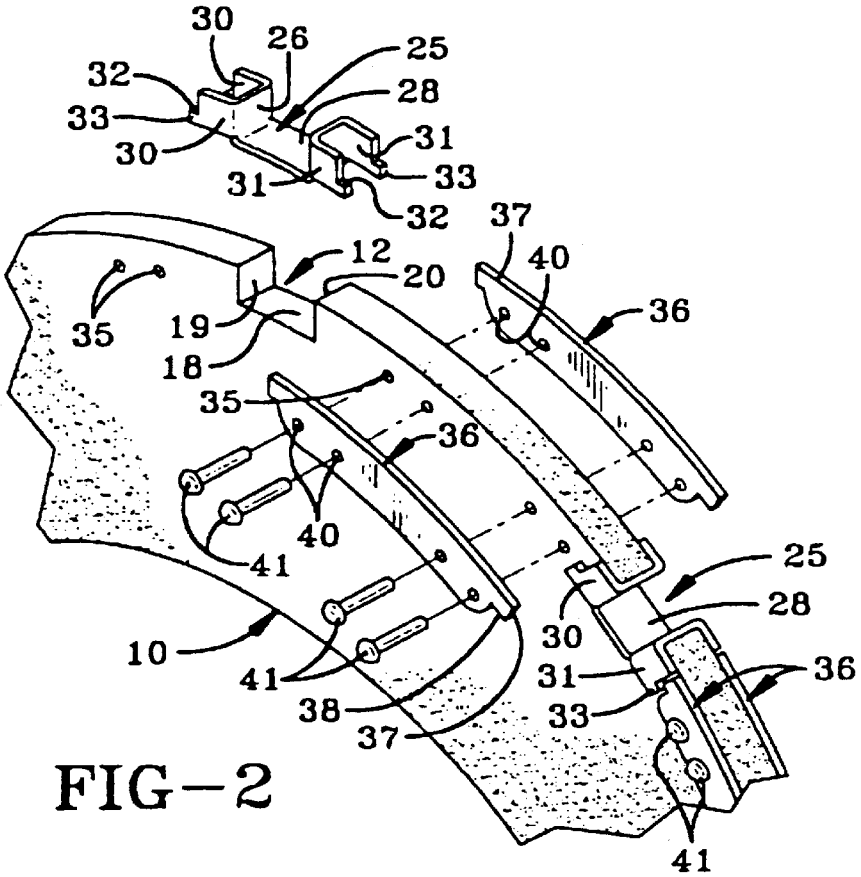
FIG. 2 is an exploded perspective view of the torque drive insert and clip in relation to a perspective view of a fragmentary portion of a rotor brake disk.

Referring to the drawings, wherein like reference numerals designate like or corresponding parts throughout the several views, there is shown in FIG. 1 a friction brake disk 10 in the form of a rotor of a multiple disk aircraft brake. Although only a portion of one rotor disk is shown, it is understood that "multiple disks" refers to the plurality of axially spaced-apart annular rotor disks which are suitably splined for axial movement along a mating key or spline 16 (shown in ghost lines) that is part of or is attached to the rotating wheel. The plurality of annular rotors are interleaved with annular stator disks which in turn are suitably splined for axial movement along a mating key member (or members) that is fixedly secured to a torque tube (not shown). Disk 10 is an annular member having flat annular wall surfaces with an inner and an outer periphery. As seen in FIGS. 1 and 2, disk 10 has a plurality of circumferentially spaced slots 12 along its outer periphery 13.

The disk 10 is fabricated from a suitable friction material such as carbon-fiber composite in known manner such as those described in U.S. Pat. Nos. 3,657,061 to Carlson; 4,790,052 to Olry; 5,217,770 to Morris et al.; 5,480,678 to Rudolf et al.; 5,546,880 to Ronyak et al. and 5,662,855 to Liew et al. but not limited thereto. Many processes for making suitable carbon-carbon composite disks are well known in the art and therefore will not be described herein.

A torque device 14 (shown in phantom lines in FIG. 1) is located adjacent to the outer periphery of the disks 10 (only a portion of one shown in FIG. 1). Torque device 14 has a plurality of splines, ribs or disk engaging members 16 projecting into slots 12 to provide a means for applying a load or force on the disk 10 by its engagement with slot 12. Slot 12 has a bottom surface 18, and two radially extending planar side walls 19 and 20. The torque device may be a wheel provided with splines, ribs or disk engaging members 16.

A metal torque drive insert 25 (FIG. 2) is located within each slot 12 to provide a reinforcement means for driving contact from the splines 16 of torque device 14. Each insert has a generally U-shaped configuration, with a pair of end sections 26 and 27 which are adapted to engage the planar side walls 19 and 20 of slot 12 such that the forces applied to the end sections 26 and 27 transfer the forces to the planar side walls 19 and 20. The end sections 26 and 27 are interconnected by a bridging section 28. The bottom surface of the bridging section 28 is in abutting contact with the bottom surface 18 of slot 12. The respective end sections 26 and 27 have a pair of arms 30 and 31 that extend outwardly away from the bridging section 28. Each of the arms 30 and 31 is notched at its upper outermost corner thereby presenting a shoulder 32 and an abutment 33. The pairs of arms 30 and 31 extend in opposite directions and are substantially parallel and lightly contact the outer peripheral annular surface of disk 10. Each pair of arms 30 and 31 straddle the periphery 13 of the disk. The outer periphery of disk 10 contains a pair of bores 35 to either side of each slot 12. Since the pairs of arms 30 and 31 of drive insert 25 extend along the periphery 13 of the disk 10, the pairs of bores 35 are located along the periphery but beyond the respective edges of the arms 30 and 31.

The torque drive inserts 25 are retained within their respective slots via clips 36. Each clip 36 is an elongated member with a recessed or reduced end defining an abutment 37 which forms a shoulder which can frictionally abut shoulder 32 of insert 25. By reducing the width of clip 36 adjacent abutment 37, a recess 38 is formed such as to receive the abutment 33 of insert 25, while the abutment 37 enters the notched upper outermost comer of the adjacent arms 30 or 31 so that the abutment 37 can frictionally abut the shoulder 32 of such arms. Each clip 36 has a pair of openings 40 which are spaced the same distance as the pairs of bores 35 along the periphery of disk 10. On aligning the openings 40 with bores 35, the clips 36 can be rigidly secured to the periphery of disk 10 by rivets 41 extending through the respective openings and bores. The clips may be formed of metal alloy that is the same as or different from that used to form the drive inserts.

In multiple disk brakes, the splines 16 of torque device 14 extend into the slots 12 of the axially aligned rotor brake disks 10. The respective slots 12 receive the drive inserts 25 such that the respective clips 36 to either side of any drive insert 25 will retain the insert 25 within the slot since the respective abutments 37 of clip 36 overlie the abutment 33 of insert 25. The shoulder 32 formed by the recess in the arms 30–31 of insert 25 thus can abuttingly contact the surface or edge of the abutment 37 of clip 36. This design permits the insert 25 to float freely in the slot 12 of the carbon disk 10 eliminating any tension thereon that otherwise would occur if insert 25 were firmly riveted to the disk 10. By permitting the floating of insert 25, the respective planar surfaces of the end sections 26 or 27 will fully contact the side walls 19 and 20 of the slot 12 in disk 10.

Stator disks (not illustrated) can also be provided with similar torque-transmitting drive inserts in a manner similar to those used in the rotor disk 10 described above. Each stator disks includes drive slots spaced around it inner periphery. A single clip can engage and retain opposite portions of two adjacent drive inserts. Clips are mounted on both sides of the flat annular surface of the disks.

In the operation of the disks 10 in multiple disk brakes, the splines 16 of torque device 14 extend into slots 12 of the axially aligned rotor brake disks 10. The axially aligned stators interleaved between the annular axially aligned and axially spaced rotor disks 10 are suitably splined for axial movement along a mating key member that is fixedly secured to a stationary torque tube and is subject to being moved axially by suitable actuators such as a piston. When the brakes are applied, the rotor disks 10 and the stator disks are axially squeezed together. The frictional forces between the faces of the rotor disks and the stator disks creates a load at the slots 12 as they bear against the splines 16 and the mating key members of the stationary brake disks. This load is transmitted to the sides or legs of the U-shaped drive inserts 25, which via their flat faces exert a force directly on the appropriate walls of slots 12. No torque load is transmitted from the drive inserts 12 to the clips or their rivets but rather distributed evenly over the flat wall surfaces of the slots of the carbon disks. When the torque load is transmitted from the drive inserts to the faces of the slots in the disks, the drive inserts seat firmly against the carbon disks. During operation, the wear faces of radially extending end sections 26, 27 of the drive inserts 25 are in frictional engagement with their corresponding confronting faces of splines 16 of torque device 14. And during operation, the wear faces of radially extending end sections of the stator disk drive inserts are in frictional engagement with their corresponding confronting faces of ribs of the torque tube not shown.

In operation, the drive inserts are subjected to sliding frictional contact due to engagement with the confronting surfaces of the associated splines 16 of the torque device 14 and ribs of the torque tube. In the case of an aircraft wheel and brake assembly, deflection of the torque device as it is rotated under load in service exacerbates such sliding frictional contact. Also, in such aircraft brake applications, operating temperatures in normal service landings and stops of the aircraft are in the range of 300 to 480° C. For this reason the drive inserts and the associated spline members have been made of high service temperature, wear resistant materials, e.g. Stellite™ 21 cobalt-base alloy for the drive inserts and Inconel™ IN 100 for the spline members, the latter additionally being provided with a wear resistant coating such as hard chrome eletroplate or flame-sprayed tungsten carbide/cobalt (WC/Co) material. Inconel™ IN 100 is a nickel base alloy available from International Nickel Company, Huntington, W.Va.

The torque drive inserts 25 are preferably formed of a ferrous metal alloy such as A286 alloy steel which has been intentionally subjected to an oxidizing step as a part of heat treatment of the inserts. The drive inserts are preferably formed by investment casting, which averts the need for subsequent machining as is typically required if other methods such as forging are used. The drive inserts could also be formed by machining from billet stock.

Subsequent to casting, the drive inserts are preferably subjected to a HIP operation, in the case of A286 alloy steel, preferably about 4 hours at 1060° C. and 103.4 MPa (15,000 psi) argon. Because the drive insert parts as formed by investment casting have a relatively low porosity, i.e. typically of about 1% and an outer skin layer of even lower porosity, no canning or seal layer need be applied prior to HIP. Following the HIP operation, the A286 alloy steel insert articles are heat treated and intentionally surface-oxidized in controlled manner during solution treatment. For articles formed of A286 alloy steel, a preferred combined heat treatment and oxidation schedule is given in Table 9 (Heat Treatment 11). For convenience of notation, "Heat Treatment" may be hereinafter abbreviated by the letters "HT."

The surface oxides of the oxidized A286 alloy steel drive inserts were examined and those listed in Table 1 below were found. The oxides were identified using X-ray diffraction and SEM (Scanning Electron Microscopy)/EDS (Energy Dispersive Scpectroscopy) microscopy.

TABLE 1

| OXIDES IDENTIFIED IN 286 | |
|---|---|
| Oxide | Chemical Formula |
| Hematite | $Fe_2O_3$ |
| Magnetite | $Fe_3O_4$ |
| Eskolaite | $Cr_2O_3$ |

In the outer layer of the surface oxide a mixture of $Fe_2O_3$ and $Fe_3O_4$ are the principal constituents absent spalling, but $Cr_2O_3$ is also typically identified, with the relative amounts of each being dependent on the heat treatment/oxidation treatment used. In a layer just above the base metal all three oxides, $Cr_2O_3$, $Fe_3O_4$ and $Fe_2O_3$ are present, but $Cr_2O_3$ is the principal constituent. As shown in FIGS. 4A through 4F, fingers of the oxides extend into the base metal and provide mechanical adhesion of the oxide layers to the base metal. Underlying the chromium oxide rich region is a nickel rich region of the base metal. The nickel rich region is believed to occur due to depletion of iron and chromium during the oxidation process.

For A286 and similar nickel chromium steels, the minimum practical temperature observed for formation of the desired oxide coating is about 880 ° C. Lower temperatures do not produce sufficient amount of the desired oxide coating in reasonable time for commercial production, which is preferably chosen to be the minimum time needed at elevated temperature that is necessary to develop the mechanical properties of the base metal. In the case of A286 alloy steel, that time is primarily based on solution treatment requirements. As expected, use of a higher temperature increases the rate of oxide formation, the thickness of the coating and the relative amounts of the oxide species. Excessive oxide coating formation is undesirable because the resulting coating is likely to spall subsequently, possibly during cooling of the article from the oxidation and heat treatment temperatures. If the oxide coating is excessively thick, severe spalling may occur since extreme thermally induced mechanical stresses arise as the temperature is changed from that at which the oxides were formed. Insufficient oxide coating formation will result in degraded tribological performance of the articles.

A286 alloy steel is a type of precipitation-hardenable stainless steel. Heat treatment guidelines for A286 alloy steel are given in "Superalloys Source Book" 9th edition, published by ASM International at pages 358–361. The following tables illustrate several of the various heat/oxidation treatments considered in order to obtain the desired oxide coating on an article formed of A286 alloy steel while also balancing the development of mechanical properties of the base metal. Note that all hold times are counted from when the article being heat treated is isothermal within the temperature range listed.

TABLE 2

| A286 HEAT TREATMENT 7 | | | | | |
|---|---|---|---|---|---|
| | | Temperature | | | |
| Treatment | Atmosphere | Minimum (C.) | Maximum (C.) | Time (hrs) | Quench |
| Solution treatment & | ambient air | 1174 | 1204 | 2.0 | Air cool to room temperature following |

TABLE 2-continued

| A286 HEAT TREATMENT 7 | | | | | |
|---|---|---|---|---|---|
| | | Temperature | | | |
| Treatment | Atmosphere | Minimum (C.) | Maximum (C.) | Time (hrs) | Quench |
| oxidation | | | | | oxidation |
| 1st age treatment | ambient air | 700 | 718 | 20 | Air cool to room temperature |
| 2nd age treatment | ambient air | 606 | 635 | 24 | Air cool to room temperature |

Heat Treatment 7 resulted in formation of excessive oxide layer, resulting in severe spallation upon cooling to room temperature.

TABLE 3

| A286 HEAT TREATMENT 8 | | | | | |
|---|---|---|---|---|---|
| | | Temperature | | | |
| Treatment | Atmosphere | Minimum (C.) | Maximum (C.) | Time (hrs) | Quench |
| Solution treatment & | Argon | 1174 | 1204 | 1.5 | After 1.5 hours introduce ambient air and continue run to oxidize |
| Oxidation | ambient air | 1174 | 1204 | 0.5 | Air cool to room temperature |
| 1st age treatment | ambient air | 700 | 718 | 20 | Air cool to room temperature |
| 2nd age treatment | ambient air | 606 | 635 | 24 | Air cool to room temperature |

Heat Treatment 8 is the same as Heat Treatment 7 except that the solution treatment portion was conducted in Argon rather than air. It should be noted, however, that industrial grade Argon gas as was used here typically includes a small amount of oxygen; i.e. about $10^{-4}$ atm, but even this small amount is sufficient to cause significant oxide formation at the temperatures employed.

TABLE 4

| A286 HEAT TREATMENT 9 | | | | | |
|---|---|---|---|---|---|
| | | Temperature | | | |
| Treatment | Atmosphere | Minimum (C.) | Maximum (C.) | Time (hrs) | Quench |
| Solution treatment & | Argon | 967 | 997 | 0.5 | After 1.5 hours introduce ambient air and continue run to oxidize |
| Oxidation | ambient air | 967 | 997 | 0.5 | In oil at room temperature |
| | | | | 1.0 | Solution treatment total time |
| 1st age treatment | ambient air | 640 | 658 | 20 | Air cool to room temperature |
| 2nd age treatment | ambient air | 640 | 658 | 24 | Air cool to room temperature |

Heat Treatment 9 resulted in development of good mechanical properties of the base A286 alloy metal, but was found to be not optimized as to formation of the desired oxide layer, although very good performance was obtained upon testing of brake torque drive inserts prepared in this manner as described further herein. HT9 produced a thinner oxide layer than desired for the drive inserts.

TABLE 5

A286 HEAT TREATMENT 10.1

| Treatment | Atmosphere | Temperature Minimum (C.) | Temperature Maximum (C.) | Time (hrs) | Quench |
|---|---|---|---|---|---|
| Solution treatment & | Argon | 885 | 915 | 1.5 | After 1.5 hours introduce ambient air and continue run to oxidize |
| Oxidation | ambient air | 885 | 915 | 0.5 | In oil at room temperature |
| | | | | 2.0 | Solution treatment total time |
| 1st age treatment | ambient air | 696 | 714 | 16 | Air cool to room temperature |
| 2nd age treatment | ambient air | 641 | 659 | 16 | Air cool to room temperature |

TABLE 6

A286 HEAT TREATMENT 10.2

| Treatment | Atmosphere | Temperature Minimum (C.) | Temperature Maximum (C.) | Time (hrs) | Quench |
|---|---|---|---|---|---|
| Solution treatment & | ambient air | 885 | 915 | 2.0 | Following Oxidation |
| Oxidation is combined with solution treatment | ambient air | 885 | 915 | | In oil at room temperature |
| | | | | 2.0 | Solution treatment total time |
| 1st age treatment | ambient air | 696 | 714 | 16 | Air cool to room temperature |
| 2nd age treatment | ambient air | 641 | 659 | 16 | Air cool to room temperature |

TABLE 7

A286 HEAT TREATMENT 10.3

| Treatment | Atmosphere | Temperature Minimum (C.) | Temperature Maximum (C.) | Time (hrs) | Quench |
|---|---|---|---|---|---|
| Solution treatment & | arbon | 885 | 915 | 0.5 | After 0.5 hour introduce ambient air and continue run to oxidize |
| Oxidation | ambient air | 885 | 915 | 1.5 | In oil at room temperature |
| | | | | 2.0 | Solution treatment total time |
| 1st age treatment | ambient air | 696 | 714 | 16 | Air cool to room temperature |
| 2nd age treatment | ambient air | 641 | 659 | 16 | Air cool to room temperature |

TABLE 8

A286 HEAT TREATMENT 10.4

| Treatment | Atmosphere | Temperature Minimum (C.) | Temperature Maximum (C.) | Time (hrs) | Quench |
|---|---|---|---|---|---|
| Solution treatment & | argon | 885 | 915 | 1.0 | After 1 hours introduce ambient air and continue run to oxidize |
| Oxidation | ambient air | 885 | 915 | 1.0 | In oil at room temperature |
| | | | | 2.0 | Solution treatment total time |
| 1st age treatment | ambient air | 696 | 714 | 16 | Air cool to room temperature |
| 2nd age treatment | ambient air | 641 | 659 | 16 | Air cool to room temperature |

Heat Treatments 10.1 through 10.4 were conducted to determine the effect of varying the amount of exposure to ambient air during solution treatment of constant total time and temperature. In all of these cases, the amount of oxide layer produced was below that desired for use in drive inserts, i.e. at least about 12.7 microns (0.5 mil), resulting in accelerated wear in subsequent pin-on-plate tribology testing compared to articles having between 25.5 and 102 microns thickness oxide layer.

TABLE 9

A286 HEAT TREATMENT 11

| Treatment | Atmosphere | Temperature Minimum (C.) | Temperature Maximum (C.) | Time (hrs) | Quench |
|---|---|---|---|---|---|
| Solution treatment & Oxidation | ambient air | 940 | 968 | 2.0 | In oil at room temperature |
| | | | | 2.0 | Solution treatment total time |
| 1st age treatment | ambient air | 718 | 746 | 16 | Air cool to room temperature |
| 2nd age treatment | ambient air | 635 | 663 | 24 | Air cool to room temperature |

Experimentation established that a change of 55° C. (100° F.) has a major influence on the thickness of the oxide layer in the range of heat treatment times considered. Changing the oxidation temperature has more influence on the amount of oxide layer formed than changing the time of exposure the same fractional amount of the base value. Increasing the oxide temperature while maintaining other parameters constant results in an increase in the relative proportion of iron oxide in the coating.

The chemistry of A286 alloy is listed below. Other iron-base superalloys such as V57 which is a slight modification of A286 and the family of iron-nickel-chrome (Incoloy™) alloys are believed to form the same desirable oxides as A286 alloy steel. These oxides formed on other superalloys likewise provide a wear resistant and lubricious coating. The elements believed to be important to the formation of these oxides are Fe and Cr. Of these, Cr is believed to be most important to obtain the desired tribological properties. It is believed that in service, the outermost iron oxide rich layer either spalls or is rapidly worn away, and that the underlying chromium oxide rich layer provides the unexpected desired tribological properties. Minor alloying elements of Si, Al, and Ti decrease the growth rate of the underlying chromium oxide rich layer, i.e., commonly referred to as the third element effect on alloy oxidation. Between the chromium oxide layer and the base metal is a nickel rich layer which is believed to be formed due to depletion Fe and Cr of the original base metal as oxidation progresses. The range of wt. % of these elements that is believed to be required to form these beneficial oxides is given in Tables 10 and 11 below.

TABLE 10

A286 CHEMISTRY

| Element | Min. wt. % | Max. wt. % | Nom wt. % |
|---|---|---|---|
| C | 0 | 0.080 | 0.040 |
| P | 0 | 0.025 | 0.013 |
| S | 0 | 0.025 | 0.013 |
| Si | 0 | 1.000 | 0.500 |
| Mn | 0 | 2.000 | 1.000 |
| Al | 0 | 0.350 | 0.200 |

TABLE 10-continued

A286 CHEMISTRY

| Element | Min. wt. % | Max. wt. % | Nom wt. % |
|---|---|---|---|
| Cr | 13.500 | 16.000 | 14.750 |
| Mo | 1.000 | 1.500 | 1.250 |

TABLE 10-continued

A286 CHEMISTRY

| Element | Min. wt. % | Max. wt. % | Nom wt. % |
|---|---|---|---|
| Ni | 24.000 | 27.000 | 25.500 |
| Ti | 1.900 | 2.350 | 2.125 |
| V | 0.100 | 0.500 | 0.300 |
| B | 0.003 | 0.010 | 0.005 |
| Co | 0 | 1.000 | 0.050 |
| Fe | balance | balance | balance |
| Total | 100 | 100 | 100 |

Source for standard chemistry of A286: AMS 5732E

It is preferable to use the nominal values listed in Table 10 for A286, except that it is preferred to have the amounts of P, S, and Co be as near to zero as is possible within practical cost constraints. Boron level of 0.012 and higher is undesired due to embrittlement.

TABLE 11

CHEMISTRY of ELEMENTS KEY TO OXIDE

| Element | Min. wt. % | Max. wt. % | Nom wt. % |
|---|---|---|---|
| Cr | 13.500 | 19.000 | 15.50 |
| Ni | 21.000 | 27.000 | 26.400 |
| Fe | balance | balance | balance |

Table 11 lists the elements that are believed key to formation of the desirable oxide coating, and their compositional range. However, for most practical applications, other alloying elements are commonly and desirably present as listed in Table 12.

TABLE 12

Base Alloy CHEMISTRY Range

| Element | Min wt. % | Max. wt. % | Nominal for Drive Insert |
|---|---|---|---|
| C | 0.0000 | 0.080 | 0.040 |
| P | 0.0000 | 0.025 | 0.015 |

TABLE 12-continued

| Base Alloy CHEMISTRY Range | | | |
|---|---|---|---|
| Element | Min wt. % | Max. wt. % | Nominal for Drive Insert |
| S | 0.0000 | 0.025 | 0.015 |
| Si | 0.0000 | 1.000 | 0.040 |
| Mn | 0.0000 | 2.000 | 0.250 |
| Al | 0.0000 | 0.350 | 0.250 |
| Cr | 13.500 | 19.000 | 15.500 |
| Mo | 1.000 | 1.500 | 1.300 |
| Ni | 21.000 | 27.000 | 26.400 |
| Ti | 1.900 | 2.350 | 2.130 |
| V | 0.100 | 0.500 | 0.300 |
| Co | 0.0000 | 1.000 | 0.050 |
| B | 0.003 | 0.010 | 0.005 |
| Fe | balance | balance | balance |
| Total | 100 | 100 | 100 |

Table 12 lists the chemistry for suitable ferrous base alloys. The preferred range of Cr is 13.5–19%. As the Cr content is increased, the Ni content is correspondingly decreased. The upper limit for Cr is determined by the need to avoid sigma phase, an iron-chrome intermetallic compound, which causes undesired embrittlement of the base metal.

Having reference to FIGS. 3A through 3F and FIGS. 4A through 4F, there is shown a specimen taken from a cast article formed of A286 alloy steel that was processed using a Heat treatment corresponding to HT 10.2 (oxidized 2 hours in air at 900° C. (1652° F.). In FIG. 3A there is shown a Secondary Electron Image of the surface view, and FIGS. 3B through 3F are EDS Elemental Images depicting the distribution of various chemical elements in the same region of the surface of the specimen as shown in FIG. 3A, but at one half the magnification of that used in FIG. 3A. FIG. 3G shows the background emission for this surface. In FIG. 4A there is shown a Secondary Electron Image of a cross section of the specimen depicted in FIGS. 3A through 3F. FIGS. 4B through 4F are EDS Elemental Images depicting the distribution of various chemical elements in the same region of the surface of the specimen as shown in FIG. 4A, but at one half the magnification of that used in FIG. 4A. FIG. 4G shows the background emission for this cross-sectional surface. The cast article has been processed according to the invention to form on its outer surfaces a protective, wear resistant, adherent coating of metal oxides from the underlying base metal, the outer surfaces including the wear surfaces intended to contact a complementary torque drive member in service. As illustrated in FIG. 4A, adjacent to the substrate of the base alloy and forming its wear surface is a coating of metallic oxides including an outer iron oxide rich region and an underlying cohesive chromium oxide rich region covering at least a portion of said wear surface. The thickness of the inner (nearest the base metal) chromium oxide rich region is preferably from about 12.7 to 51 microns (½–2 mils). Underlying the chromium oxide rich region is a nickel rich region of the base metal. The thickness of the outer iron oxide rich (nearest the outer surface of the article) region is preferably about 12.7 to 51 microns (½–2 mils). The total thickness of the coating of metal oxides is preferably about 25 to 102 microns (1–4 mils). Generally, the structure of the coating is as shown in these photomicrograph reproductions, although the overall thickness of the coating and the relative thickness of the inner and outer regions will vary according to the composition of the base metal and the oxidizing conditions employed during manufacture of the article.

Some of the completed drive inserts were installed in a multi-disk carbon brake equipped with rotor drive splines formed of Inconel™ 100 that was flame spray coated with a tungsten carbide/cobalt material (WC/Co) commercially available from White Engineering Surfaces Corporation, Philadelphia, Pa., and tested on a laboratory road wheel dynamometer. Other completed drive inserts were installed in a multi-disk carbon brake equipped with rotor drive splines formed of Inconel™ 100 that was coated with electroplated chromium from Armaloy of Ohio Inc., Springfield, Ohio, and tested on a laboratory road wheel dynamometer.

EXAMPLE 1

Figure 5:
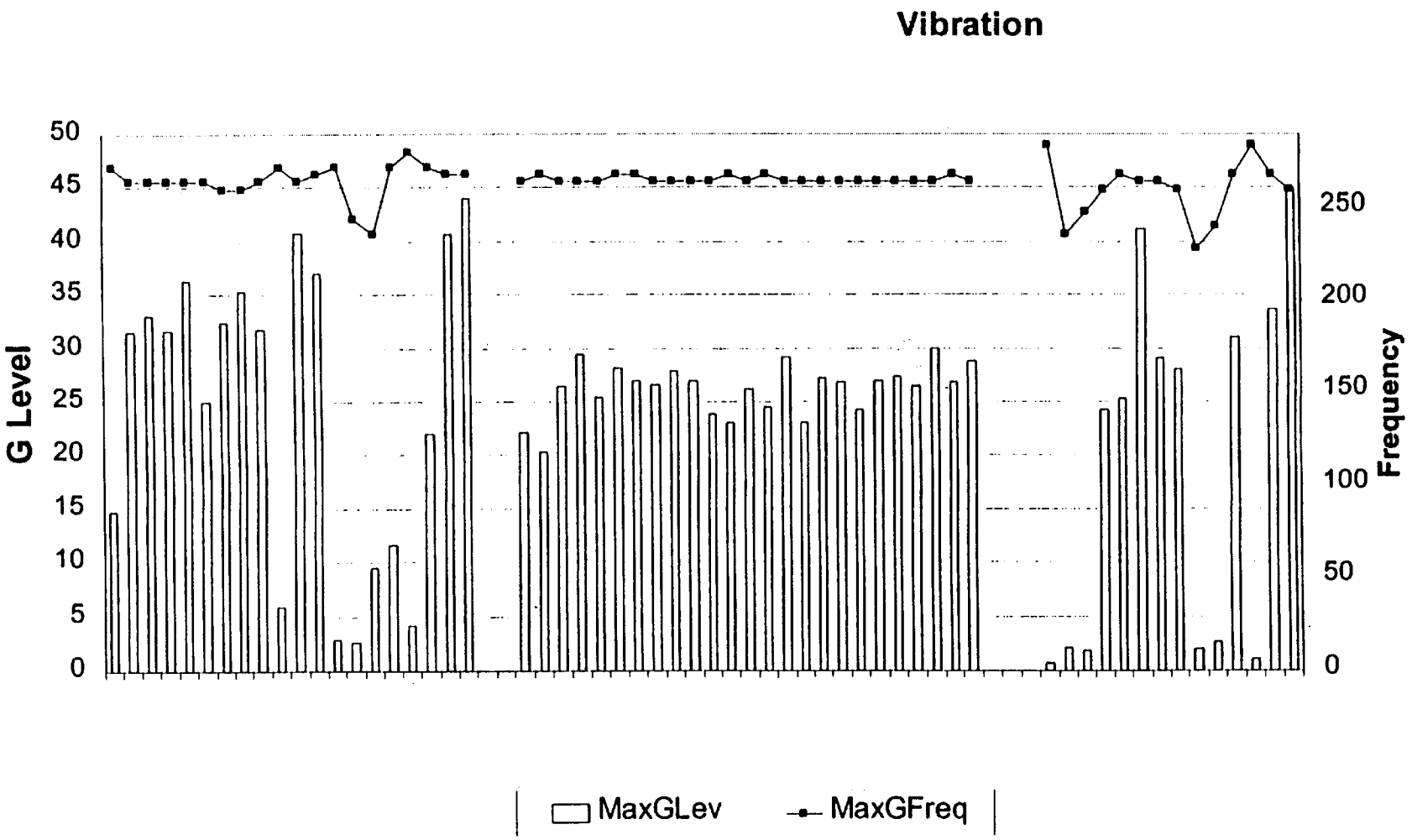
FIG. 5 is a graph of the comparative vibrational response of a multiple disk brake assembly fitted with torque drive inserts according to the prior art and a similar multiple brake assembly fitted with torque drive inserts according to the invention.

For comparison purposes, two heat sinks for a large multi-disk aircraft brake of the same design, size and configuration were made from the same production lot of carbon-carbon composite material. In one heat sink, the rotor disks were fitted with drive inserts of AMS 5385F cobalt-base alloy In the other heat sink, the rotor disks were fitted with drive inserts of A286 alloy steel having an oxide coating according to the invention using Heat Treatment 9. Both heat sinks were thereafter tested on a laboratory road wheel dynamometer equipped with apparatus to simulate the response of a wheel and brake assembly mounted on the corresponding aircraft landing gear. In both instances, the wheel of the multi-disk brake and wheel assembly was equipped with rotor drive splines formed of Inconel™ IN 100 nickel-base alloy whose drive contact surfaces had been treated by electro-plated chromium material as described hereinabove. As shown in FIG. 5, there are three groups of data. The left and right groups of bars and associated data points above the middle group of bars represent the observed vibration level for a series of service energy stops of a carbon-carbon multi-disk brake having rotors that are equipped with drive inserts of AMS 5385F cobalt-base alloy. The middle group of bars and data points above the bars represent the observed vibration level for a series of service energy stops of a carbon-carbon multi-disk brake having rotors that are equipped with drive inserts of A286 alloy steel prepared according to Heat Treatment 9 described hereinabove, having a coating of metallic oxides including an outermost iron oxide rich region and thereunder an inner chromium oxide rich region covering the entire exterior surfaces of the drive inserts, including their wear contacting portions. The data groups were obtained by testing in the order indicated in FIG. 5 from left to right, i.e., the left group of tests was run before the middle group, and the middle group was run before the right group. The right group of tests was run to ensure that the dynamometer data acquisition system had not shifted after the first tests of the brake fitted with drive inserts of AMS 5385F cobalt-base alloy. Each vertical bar corresponds to a service energy stop which consists of a 7-stop cycle simulating an aircraft landing event and subsequent taxiing to an airport gate or docking station. For use in friction contact, at least a portion of, and preferably, the entire wear surface should be covered with the oxide coating. In FIG. 5, the observed vibrational level is expressed as a vertical bar for each service energy braking event in Gs of acceleration, one G corresponding the acceleration rate of the gravity of the Earth. The dominant frequency of the vibration is recorded as a generally horizontal line graph above the bars, and ranges from about 220 to about 270 Hz, with a dominant frequency of about 255 Hz observed on most tests. As can be seen in FIG. 5, the observed vibration level for the brake heat sink fitted with AMS 5385F drive inserts varied greatly from stop to stop, and often exceeded 30 Gs. Also, the dominant frequency varied from about 220 to about 270 Hz. In contrast, a similar heat sink from the same lot of carbon-carbon material fitted with drive inserts of A286 alloy steel having an oxide coating according to the invention resulted in vibration levels that varied from about 20 Gs to about 30 Gs, far more constant from stop to stop than the heat sink fitted with inserts of AMS 5385F. Also, for the heat sink fitted with drive inserts of A286 alloy steel having an oxide coating according to the invention, the observed dominant frequency was nearly constant from stop to stop at about 255 Hz. The dynamic performance of the brake fitted with the A286 alloy steel oxide-coated drive inserts was notably better, because the amplitude of the vibrational force was lower, and more constant from braking event to braking event as to both amplitude and dominant frequency of vibration. For certain commercial aircraft, a dynamic vibration level above 30 Gs is unacceptable due to the potential of adverse influence on the aircraft. Also, when the dominant frequency of the vibration is constant, it is easier to tune or damp the affected system by design and thereby avoid potentially destructive resonant vibration of associated structures such as landing gear.

EXAMPLE 2

Figure 6:
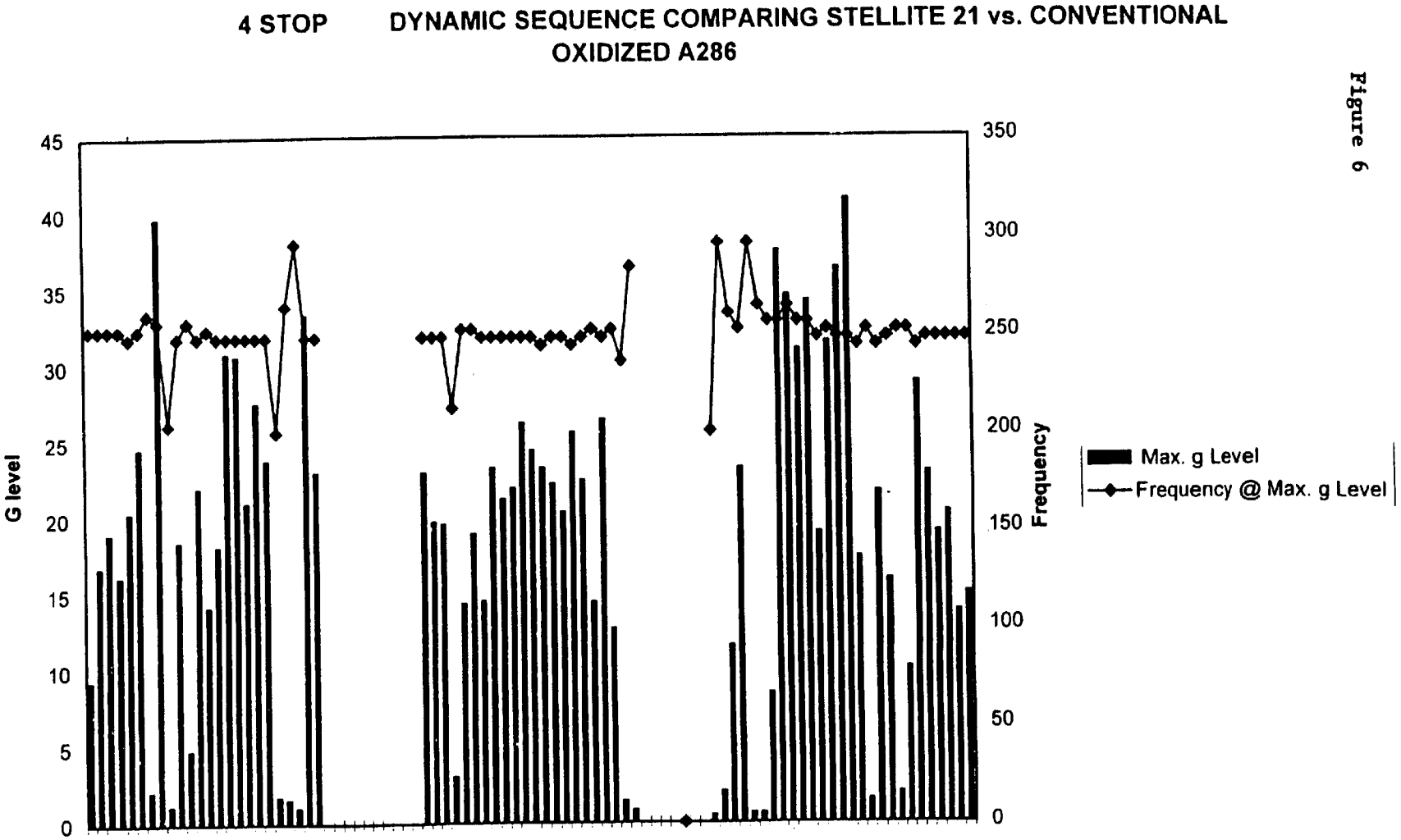
FIG. 6 is a graph of the comparative vibrational response of a multiple disk brake assembly fitted with torque drive inserts according to the invention and the same multiple disk brake assembly fitted with torque drive inserts according to the prior art.

Because the testing described in Example 1 and summarized in FIG. 5 was obtained from testing of two different carbon-carbon heat sinks, it was first thought that the variation from heat sink to heat sink might have dominated the observed results, and not the difference in drive inserts. Therefore, another aircraft brake heat sink of the same model configuration as used in Example 1 was fabricated having friction disks of carbon-carbon material of the same type and tested in the same manner on the same laboratory dynometer setup. For this particular brake, a vibrational force not exceeding 25 Gs was desired at 250 Hz. For the first series of service stops shown in the left data group in FIG. 6, the rotors of the multi-disk brake were fitted with drive inserts of AMS 5385F cobalt-base alloy. Thereafter, the brake was disassembled and the rotors were refitted with drive inserts of A286 alloy steel having an oxide coating according to the invention prepared according to Heat Treatment 9, the test data being presented as the middle group in FIG. 6. Thereafter, the brake was disassembled and the rotors were refitted with drive inserts of AMS 5385F cobalt-base alloy, this test data is presented as the right group in FIG. 6. Once again, the brake fitted with drive inserts of oxide coated A286 alloy steel exhibited greater dynamic stability against vibration from stop event to stop event. When fitted with drive inserts of AMS 5385F cobalt-base alloy, several of the service stop events exhibited an amplitude in excess of 25 Gs, with some exceeding 30 Gs, others exceeding 35 Gs and still others exceeding 40 Gs. When the same brake heat sink was fitted with drive inserts of A286 alloy steel having an oxide coating according to the invention, only three of the service stop events exceeded 25 Gs, and those only by about 2 Gs. Similarly, the observed frequency at maximum vibrational force level was more stable from stop to stop and varied within a narrower range for the brake fitted with drive inserts of A286 alloy steel having an oxide coating according to the invention. Additionally and notably, the dynamic stability performance of the brake when refitted with the cobalt-base alloy drive inserts reverted to the pattern observed in the first group of service stop tests. The vibrational performance observed during this last group of service stop tests was worse than during the first group of service stop tests for this brake as presented on the left of FIG. 6.

EXAMPLE 3

Similar dynamic brake stability testing was also conducted on another large aircraft multi-disk brake model whose rotor drive splines were formed of Inconel™ In 100 nickel-base alloy whose drive surfaces had been treated by commercial flame spray coating with tungsten carbide/cobalt (WC/Cr) material as described hereinabove. As in Examples 1 and 2, the brake equipped with rotor drive inserts of oxide coated A286 alloy steel exhibited greater dynamic stability against vibration from stop event to stop event compared to another brake of the same model equipped with drive inserts of AMS 5385F cobalt-base alloy.

EXAMPLE 4

The testing summarized in Example 3 was repeated with the following change: rotors 1, 3 and 5 were equipped with drive inserts of oxide coated A286 alloy steel and rotors 2 and 4 were equipped with drive inserts of AMS 5385F cobalt base alloy. This brake also exhibited greater dynamic stability against vibration from stop event to stop event compared to another brake of the same model in which all drive inserts were of AMS 5385F cobalt-base alloy.

The sliding frictional characteristics of various combinations of materials are summarized in Tables 13 and 14. Pins of A286 treated to form the desired adherent oxides layer were also tested to determine friction and wear characteristics in sliding contact with flat metal plates that were coated to correspond to the coating on the brake drive splines. The testing was conducted on a Cameron Plint TE77 High Frequency Friction Machine per ASTM G 133/95 "Standard Test Method for Linearly Reciprocating Ball-on-Flat Sliding Wear" addressing the dry and lubricated wear of ceramics, metals and ceramic composites. The Cameron Plint TE77 High Frequency Friction Machine was designed for the evaluation of lubricants and the friction and wear properties of materials in dry and lubricated reciprocating sliding or rolling/sliding contact conditions. The moving specimen (pin) is mounted in a carrier head and loaded against the fixed specimen (plate) by a spring balance through a lever and stirrup mechanism. The normal force is transmitted directly onto the moving specimen by means of the needle roller cam follower on the carrier head and the running plate on the loading stirrup. A strain gauge transducer is mounted on the lever at a point directly beneath the point of contact and this measures the applied load. The specimen (pin) is oscillated mechanically against the fixed lower specimen (plate). The mechanical drive which consists of an eccentric cam, scotch yoke and plain guide bearings is controlled by a tachometer generator feedback to ensure a stable oscillating frequency to compensate for changing friction conditions and changing temperature due to friction. The fixed specimen (plate) is located on two screw fittings in a stainless steel reservoir. The reservoir is clamped to a block that is heated by four electrical resistance elements. Temperature of the fixed specimen is monitored and controlled to a given set point. The heater block is mounted on two flexures which are stiff in the vertical (loading) direction, but offer small resistance to horizontal forces. Movement in the horizontal direction is resisted by a stiff piezo-electric force transducer and this measures the friction forces in the oscillating contact. A Cameron Plint apparatus is available at the NASA Lewis Research Center, Cleveland, Ohio.

The results of sliding-friction-and-wear testing confirmed the self-healing (self-reforming) nature of the desired adherent oxides layer, as the pin heads became worn from their initial rounded configuration to one having a flattened end due to contact with the plate. The observed coefficient of friction remained essentially constant throughout the testing.

TABLE 13

AVERAGE VALUES
Wear Rate(in./hr) Tungsten Carbide Cobalt coated IN100 plates

| Temp (° C.) | Bare Cast Stellite21 | Bare A286 Cast HT7 | Oxidized Conversion A286 Cast HT7 | Oxidized Conversion A286 Cast HT10.2 | Oxidized Conversion A286 Wrought HT10.2 | Oxidized Conversion A286 Cast HT11 |
|---|---|---|---|---|---|---|
| 22 | 0.028 | 0.48 | 0.053 | 0.0468 | 0.073 | 0.051 |
| 315 | 0.025 | 0.024 | 0.014 | 0.0274 | 0.025 | 0.028 |

TABLE 14

AVERAGE VALUES
Coefficient of Friction Tungsten Carbide Cobalt coated IN100 plates

| Temp (° C.) | Bare Cast Stellite21 | Bare A286 Cast HT7 | Oxidized Conversion A286 Cast HT7 | Oxidized Conversion A286 Cast HT10.2 | Oxidized Conversion A286 Wrought HT10.2 | Oxidized Conversion A286 Cast HT11 |
|---|---|---|---|---|---|---|
| 22 | 0.679 | 0.873 | 0.494 | 0.5784 | 0.617 | 0.572 |
| 315 | 0.706 | 0.844 | 0.579 | 0.5117 | 0.538 | 0.495 |

Various modifications are contemplated and may obviously be resorted to by those skilled in the art without departing from the described inventions as hereinafter defined by the appended claims, as only a preferred embodiment thereof has been defined.

What is claimed is:

1. An article of manufacture comprising: a substrate of ferrous alloy having a wear resistant surface having a coating of metallic oxides including an outer iron oxide rich region, an underlying chromium oxide rich region that is cohesively attached to an inner cohesive nickel rich region of the base metal, wherein the coating is formed by oxidation of the surface of the article at a temperature of at least 880° C.

2. The article of claim 1 wherein the substrate alloy has the following composition:

| Element | Min. wt. % | Max. wt. % |
|---|---|---|
| C | 0.0000 | 0.080 |
| P | 0.0000 | 0.025 |
| S | 0.0000 | 0.025 |
| Si | 0.0000 | 1.000 |
| Mn | 0.0000 | 2.000 |
| Al | 0.0000 | 0.350 |
| Cr | 13.500 | 19.000 |
| Mo | 1.000 | 1.500 |
| Ni | 21.000 | 27.000 |
| Ti | 1.900 | 2.350 |
| V | 0.100 | 0.500 |
| B | 0.003 | 0.010 |
| Co | 0.0000 | 1.000 |
| Fe | balance | balance |
| Total | 100 | 100 |

and the coating compries oxides of Fe abd Cr.

3. The article of claim 2 in the form of a drive insert for a friction disk.

4. The article of claim 2 wherein the substrate alloy is A286 alloy steel having an inherent oxide coating formed by exposure of the article to an oxidizing atmosphere at a temperature between 885 and 915° C. for a time sufficient to form a coating thickness is from about 6 to 102 microns (¼ to 4 mils).

5. The article of claim 4 wherein the time of exposure to elevated temperature oxidizing conditions is from about 0.3 to 2.0 hours.

6. The article of claim 5 wherein the coating is self healing during sliding fictional engagement of the coated surface of the article with one of a hard chromium surface and a flame sprayed WC/Co composite alloy surface.

7. The article of claim 6 in the form of a drive insert for a friction disk.

8. The article of claim 4 in the form of a drive insert for a friction disk.

9. The article of claim 2 wherein the coating thickness is from about 12.7 to 102 microns (½ to 4 mils).

10. The article of claim 2 wherein the coating thickness is from about 25.5 to 76 microns (1 to 3 mils).

11. The article of claim 1 wherein the coating thickness is from about 12.7 to 102 microns (½ to 4 mils).

12. The article of claim 1 wherein the coating thickness of the chromium oxide rich layer is from about 12.7 to about 51 microns (½ to about 2 mils).

13. The article of claim 12 in the form of a drive insert for a friction disk.

14. The article of claim 1 in the form of a drive insert for a friction disk.

15. An aircraft brake assembly having a brake stack comprising a plurality of interleaved stator and rotor friction disks wherein at least one of the disks in the brake stack includes a plurality of torque drive notches spaced around its circumferential direction that are provided with drive inserts including a substrate of ferrous alloy having a wear surface, and a coating of metallic oxides including an outer iron oxide rich region and an inner chromium oxide rich region and an underlying cohesive nickel rich layer covering at least a portion of said wear surface, the brake assembly having increased dynamic stability against vibration during a braking event compared to an otherwise identical brake having a brake stack in which all of the drive inserts are formed of AMS 538F cobalt-base alloy.

16. The brake assembly of claim 15, wherein the coating on the inserts is formed by oxidation of the inserts.

17. The brake assembly of claim 15, wherein the inserts are formed of A286 alloy steel having an adherent oxide coating formed by exposure of the inserts to an oxidizing atmosphere.

18. The brake assembly of claim 15 wherein the inserts are formed of ferrous alloy of the following general composition expressed in weight percent: C 0–0.8, Cr 13.5–19, Ni 21–27, the inserts having an adherent oxide coating formed by the exposure of inserts to an oxidizing atmosphere at a temperature of at least 880° C.

19. The brake assembly of claim 18, wherein the inserts have an oxide coating thickness of from about 6 to 102 microns (¼ to 4 mils).

20. The brake assembly of claim 18, wherein the inserts have an oxide coating thickness of from about 25 to 102 microns (1 to 4 mils) formed by exposure of the inserts to ambient air.

* * * * *